US005096100A

United States Patent [19]

King et al.

[11] Patent Number: 5,096,100

[45] Date of Patent: Mar. 17, 1992

[54] GARMENT DISPLAY FORMER

[75] Inventors: Andrew King; Roberto Ridolini, both of Leicester, England

[73] Assignee: Kenilworth Components Ltd., Leicester, England

[21] Appl. No.: 616,235

[22] Filed: Nov. 20, 1990

[30] Foreign Application Priority Data

Nov. 24, 1989 [GB] United Kingdom ..... 8926589
Feb. 8, 1990 [GB] United Kingdom ..... 9002803

[51] Int. Cl.[5] ..... D06B 15/00

[52] U.S. Cl. ..... 223/84; 223/37; 223/71; 223/66; 206/494; 206/292; 206/293

[58] Field of Search ..... 223/37, 38, 84, 66, 223/71, 87; 206/494, 292, 293

[56] References Cited

U.S. PATENT DOCUMENTS

| | | | |
|---|---|---|---|
| 1,906,972 | 5/1933 | Liebowitz | 223/37 X |
| 2,296,138 | 9/1942 | Bezark | 223/71 |
| 2,327,196 | 8/1943 | Lighter | 223/37 X |
| 3,298,553 | 1/1967 | Ruettger | D6/315 X |
| 3,837,544 | 9/1974 | Greenwald | 223/87 |
| 3,891,129 | 6/1975 | Knappe et al. | 223/37 |
| 4,134,524 | 1/1979 | Nakano et al. | 206/292 X |
| 4,391,394 | 7/1983 | Hoffman | 223/37 |
| 4,569,441 | 2/1986 | Inghirami | 206/292 |
| 4,629,101 | 12/1986 | Franklin | 223/84 X |

FOREIGN PATENT DOCUMENTS

| | | | |
|---|---|---|---|
| 2335129 | 7/1973 | Fed. Rep. of Germany | 206/241 |
| 1381438 | 4/1973 | United Kingdom | 206/292 |

*Primary Examiner*—Werner H. Schroeder
*Assistant Examiner*—Bibhu Mohanty
*Attorney, Agent, or Firm*—Longacre & White

[57] ABSTRACT

A display former or frame is adapted to receive folded on or about it a garment such as a shirt and has a support for the shirt collar. A locking support frame provides two bars, over one of which a lower or tail portion of the shirt is folded and the other bar has a hook engagement with the upper part of the former frame in order to secure the fully folded shirt on the former. Arms of the hook engagement may have a resilient motion to retain the bar in engagement with the hooks. Gripping means is also shown provided for receiving outer shoulder portions of the shirt to facilitate their folding behind the former and to obtain a taut fit of the shirt about the former.

10 Claims, 10 Drawing Sheets

GARMENT DISPLAY FORMER

BACKGROUND OF THE INVENTION

The present invention relates to a garment display former and particularly, but not exclusively, to such a former for displaying shirts.

It has been a long standing practice to support a shirt on a former for display purposes. The former is usually a sneer of card or board to which is attached by pins or clips to the body portion of the shirt, often with a cuff pinned onto the shirt front panel. The shirt collar is normally separately supported by a further narrow strip of cardboard or plastic which is placed underneath the collar in the position occupied by a tie when the shirt is worn. The thus assembled shirt is finally placed in a bag at least the front portion of which is transparent for viewing by potential customers.

One of the disadvantages of this traditional display arrangement is that it is time consuming and thus expensive to produce and assemble. An object of the invention is to avoid such disadvantage and enable a garment to be quickly displayed on a former whilst a further object is to provide a former on which a shirt or other garment can be readily folded or arranged for display without the use of pins or clips or with minimal use of them.

SUMMARY OF THE INVENTION

According to one aspect of the invention a garment display former is characterised by a former member such as a frame for receiving an upper portion of a garment folded or arranged thereon and a locking support member for carrying a lower portion of a said garment and arranged to have a releasable retentive engagement with an upper part of the former member in order to secure and lock the garment in a folded condition on the latter.

The locking support member may have a releasable hook engagement with the former member and may provide a pair of spaced apart bars or the like, one of which receives the lower part of a garment folded over it and the other is adapted to have a releasable retentive or hook engagement with the former member. Retentive or hook engagement means may have a resilient action for retaining the engagement between the locking support member and the former member yet enable such engagement to be released for removal of the locking support member from the former member.

According to another aspect of the invention a former member of a garment display former is provided with gripping or retaining means for retentively receiving upper outer side portions of a garment behind the former in facilitating the arranging or folding of the garment on the former member.

The gripping or retaining means can be conveniently of slotted form with preferably toothed or serrated gripping edges for receiving the garment upper outer side portions whilst the means may depend from a central upper part of the former member.

DESCRIPTION OF THE DRAWINGS

Practical examples of the former for shirt display purposes are shown in the accompanying drawings in which.

DETAILED DESCRIPTION

Figure 1:
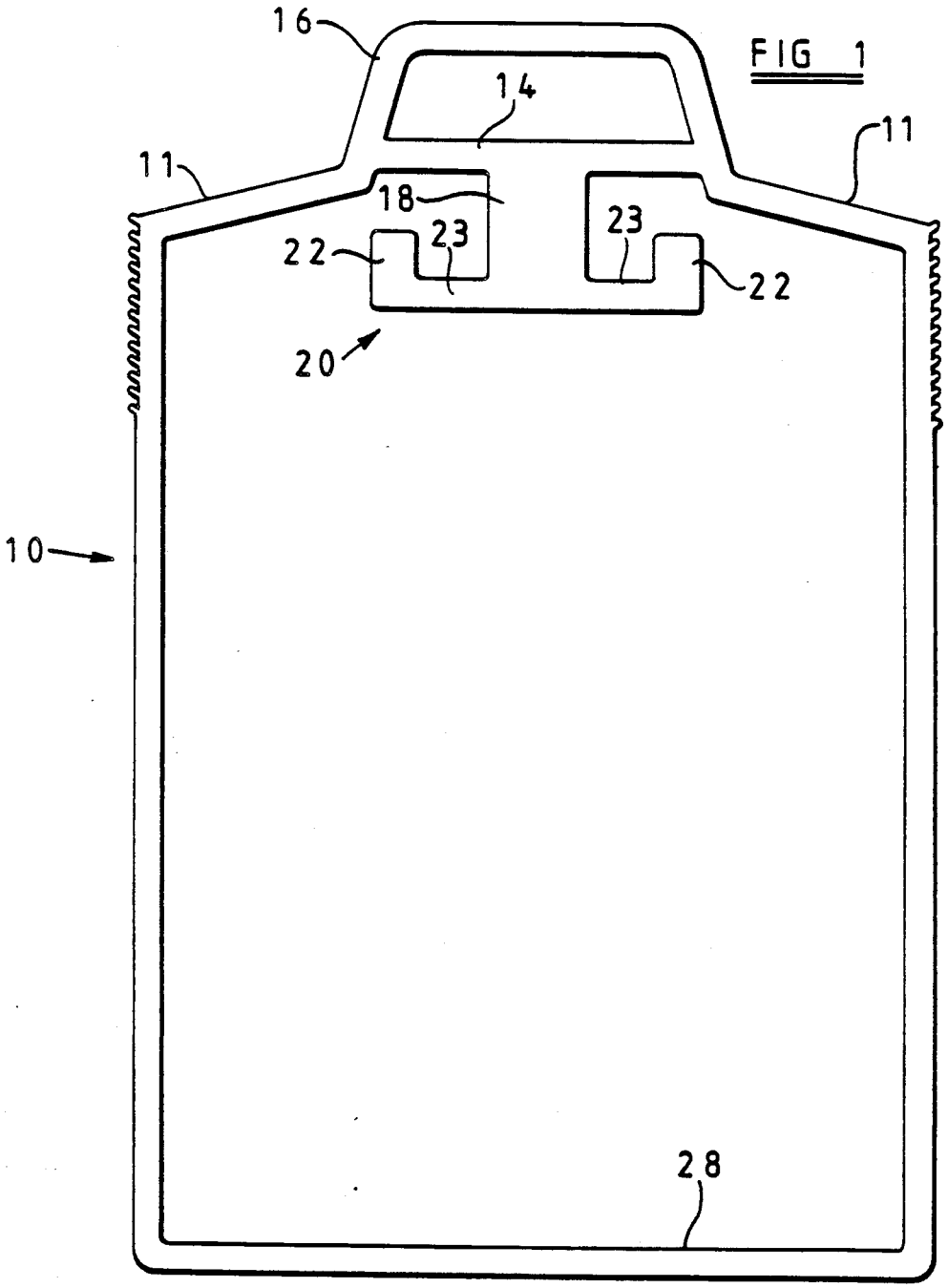
FIG. 1 is a rear elevation of the former frame.

Referring firstly to FIG. 1, the display former 10 comprises a generally rectangular frame preferably produced as a moulding in suitable plastics material such as polystyrene or polypropylene, the upper part of which tapers upwardly and inwardly as shoulder portions 11 towards a cross piece 14 which carries a collar support 16 and also a depending central part 18 carrying a part of locking or retaining means shown generally at 20. The sides of the former 10 preferably also have some inward taper towards the lower end of the frame. The size and/or shape of the frame of the former 10 can be varied according to requirements.

Figure 1A:
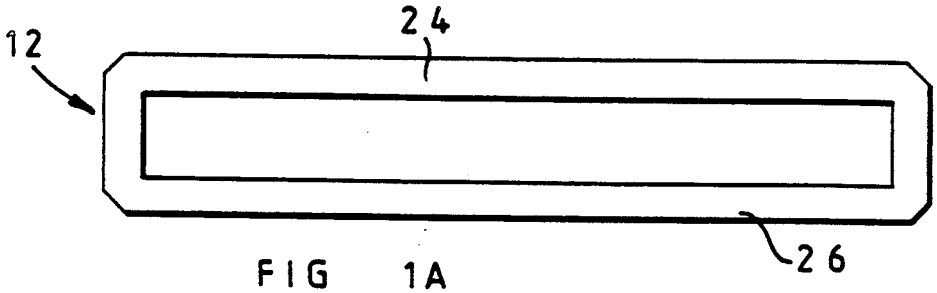
FIG. 1A is an elevation of a locking support member.

That part of the locking or retaining means 20 forming part of the former 10 is generally of a U-shaped arrangement in which a pair of spaced apart upstanding hooks 22 are each carried by respective arms 23 integral with the central part 18, which hooks 22 receive one bar 24 of a rectangular locking support 12, of slotted or frame from (FIG. 1A), the other bar 26 of the latter providing support for the lower part of a shirt displayed on the former 10. The locking support frame 12 may be also produced as a polypropylene or other plastics moulding.

Figure 2:
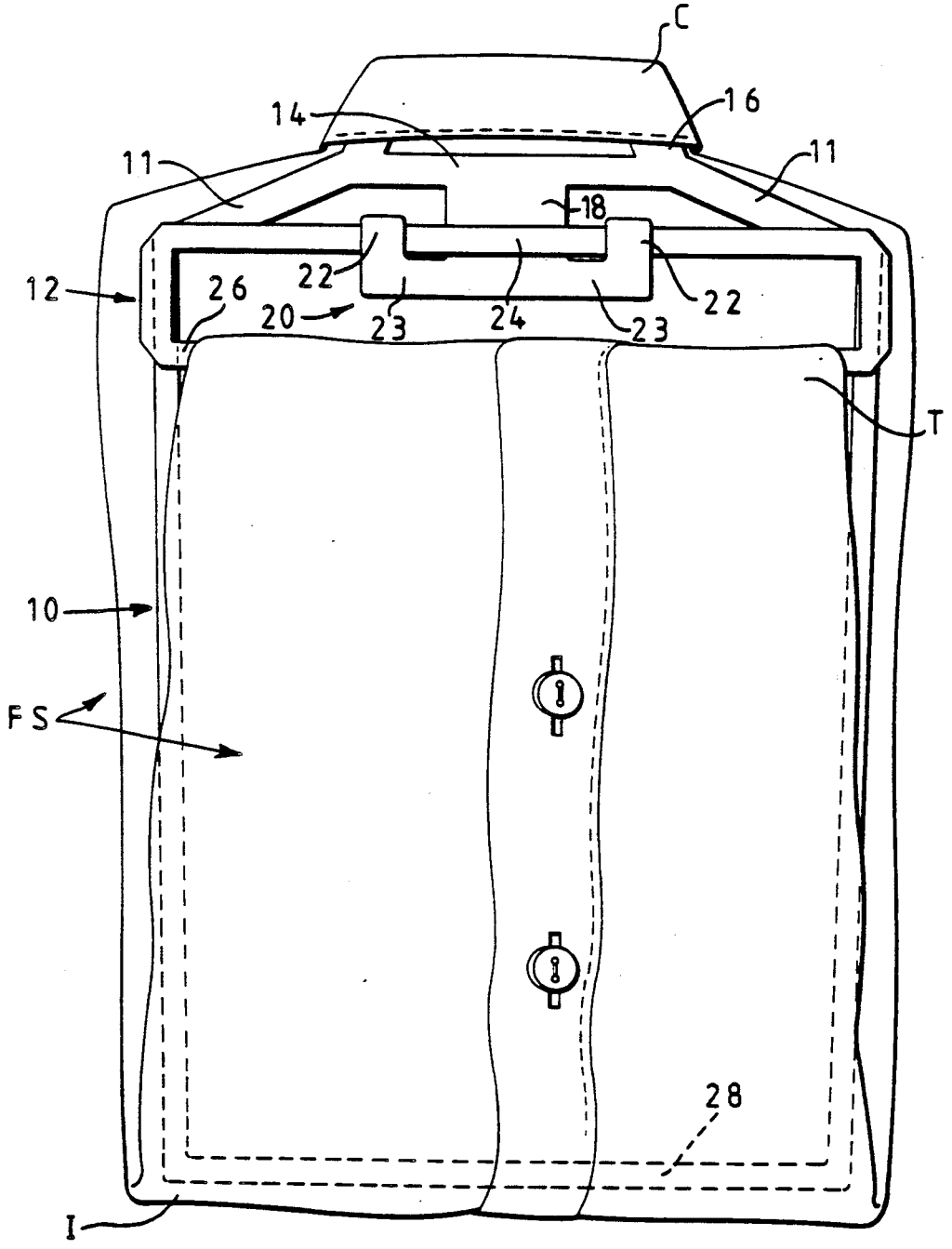
FIG. 2 is a rear elevation showing a shirt secured in a folded condition on the former.

In use the shirt S is folded or arranged on and about the former 10 for display of the front upper portion of the shirt on the front of the former in the traditional manner and with the collar support 16 inserted under the rear part of the shirt collar C. Outer side portions of the shirt including outer shoulder portions and sleeves are folded behind the former 10. As shown in FIG. 2 an intermediate front portion I of the shirt S is brought under the lower cross piece 28 of the former frame 10 and up behind the latter after or before which front and rear parts of the lower or tail portion T of the shirt are inserted in the locking support frame 12 and folded forwardly over the bar 26. The locking support frame 12 is then raised behind the former to engage the bar 24 with the hooks 22 of the locking or retaining means 20 on the former 10.

Figure 3:
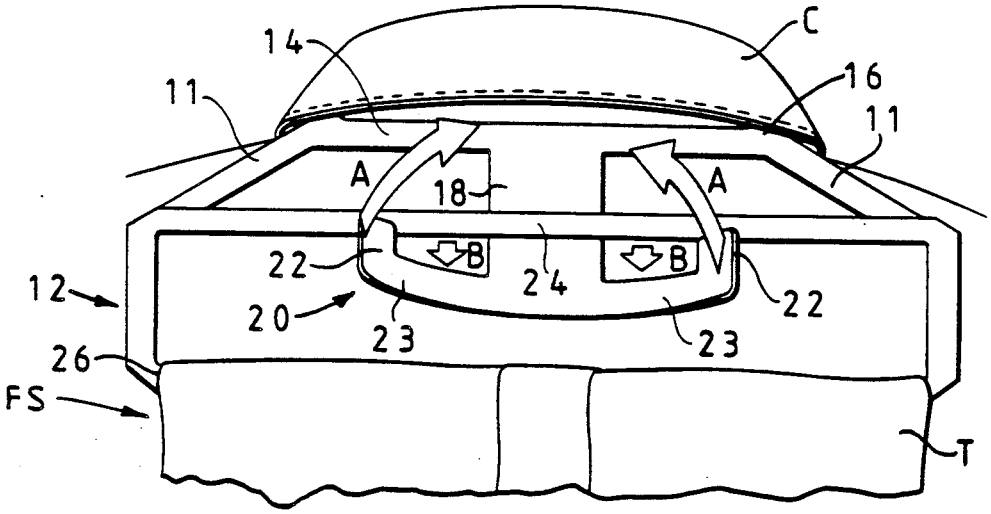
FIG. 3 is a detail rear view showing the engagement of the locking support member with the former.

During such engagement the pair of arms 23 carrying the hooks 22 are bent slightly upwardly in the direction of the arrows A,A, (FIG. 3) i.e. out of the plane of the paper. In this position the bar 24 is slid in the direction of the arrows B,B into the base of the locking or retaining means 20 and the arms 23 released. Due to the natural resilience of the polypropylene or like plastics material the arms 23 and hooks 22 return to their original position substantially in the plane of the former 10. In this way the bar 24 becomes trapped between the hooks 22 and the central part 18. After final preparations, the fully folded shirt FS secured on the former 10 is placed in a package such as a polythene bag ready for sale.

When a purchaser wishes to remove the shirt S from the former 10 it is simply necessary to slightly raise the hooks 22 in order to release the bar 24 of the locking support 12 for removal, withdraw the lower portion T of the shirt from the latter and then unfold the shirt from the former 10.

The locking support 12 may take any suitable shape or form other than that shown in the drawings whilst it may, for example, be provided with hooks for engagement with the cross member 14 or the like of the upper part of the former 10.

Figure 4:
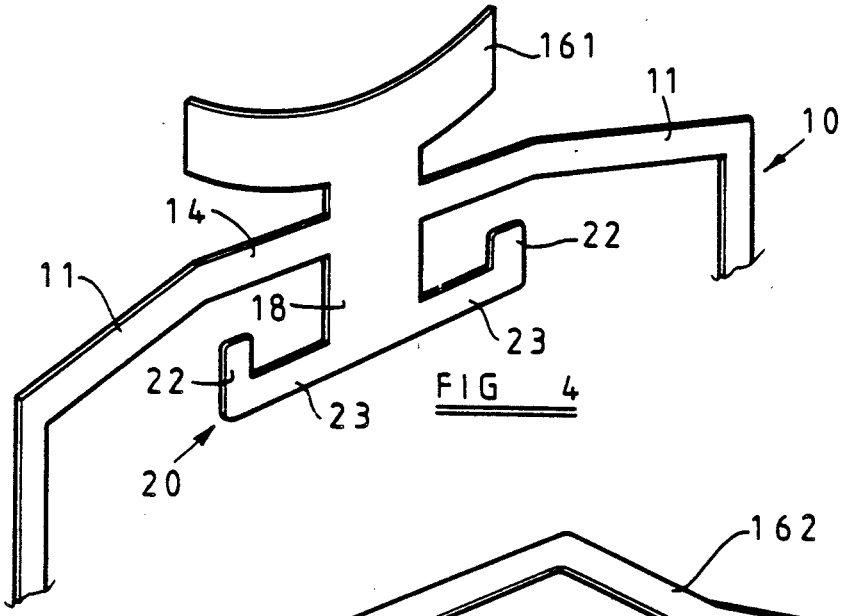
FIGS. 4 and 5 are detail rear perspective views each showing an alternative form of shirt collar support.
Figure 5A:
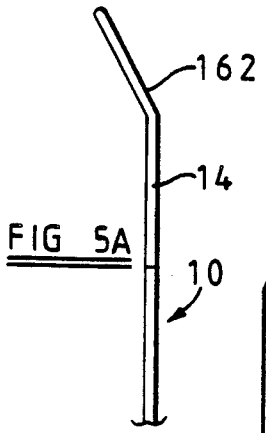
FIG. 5A is a side edge view of FIG. 5.
Figure 5:
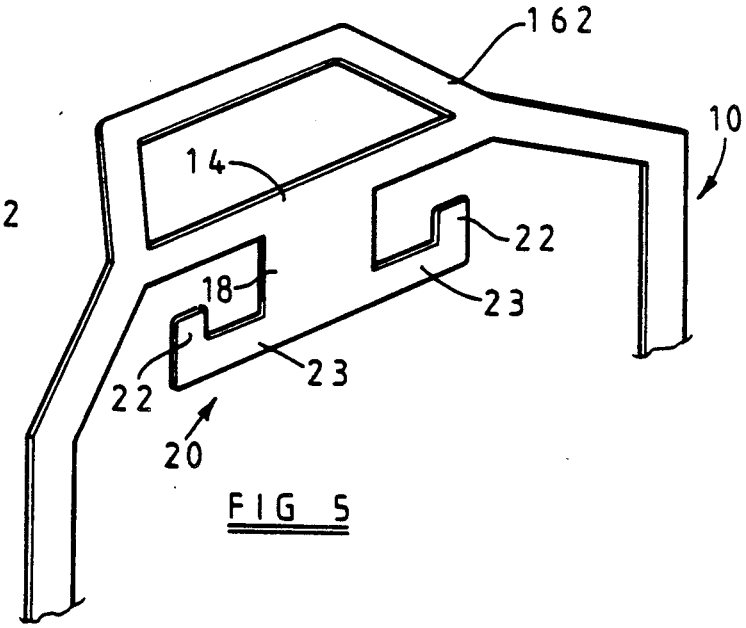

Referring to FIGS. 4 and 5 alternative forms of collar support are shown. Thus in FIG. 4 the collar support 161 is shown curved in order to more accurately correspond to the shape of the back of a wearer's neck. In FIG. 5 the collar support 162 is bent forwardly so as to assume a front raised position from the plane of the former 10.

Figure 6:
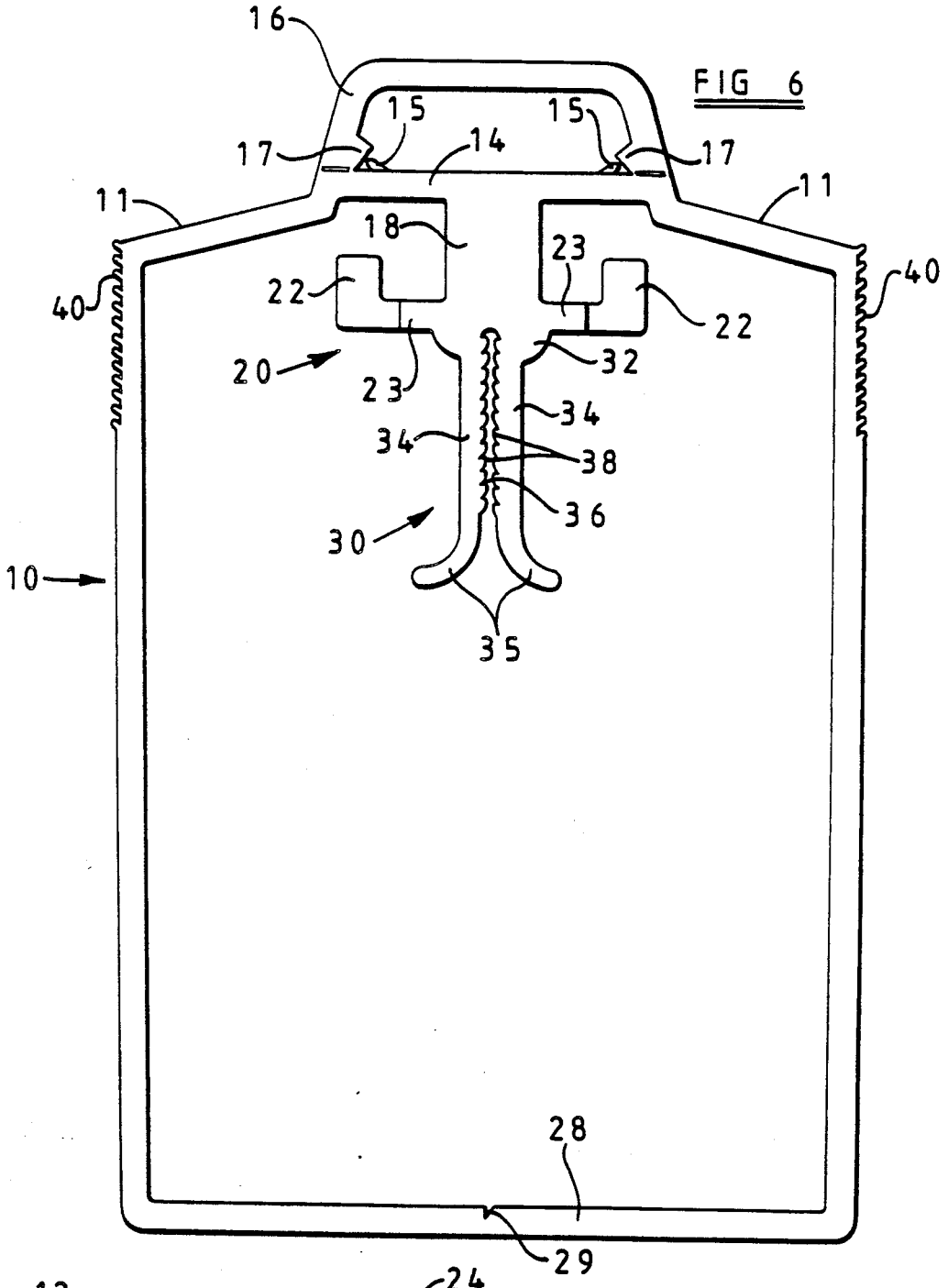
FIG. 6 is a rear elevation of the former frame provided with garment gripping means.
Figure 6A:
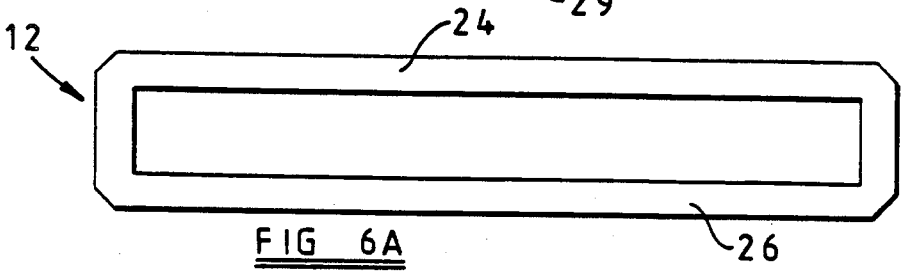
FIG. 6A is an elevation of a locking support member for the former shown in FIG. 6.

In accordance with a further feature of this invention the former 10 (FIG. 6) is provided with gripping or retaining means 30 to facilitate the folding or arranging of a shirt thereon and for this purpose a depending extension 32 of the central part 19 is bifurcated to provide a pair of depending parallel limbs 34 defining a slot 36 between them, the opposed edges of the limbs 34 being serrated or toothed at 38 for gripping engagement with material of the shirt inserted and pulled through the slot 36. Upper exterior side portions of the former frame 10 are also shown similarly serrated or toothed at 40, in each case the teeth or serrations 38,40 being of buttress or ratchet form to resist downward movement of the shirt material relative to the former 10. To prevent damage to the shirt material the points of the teeth 38, 40 should not be sharp but preferably of rounded form as shown.

Figure 7:
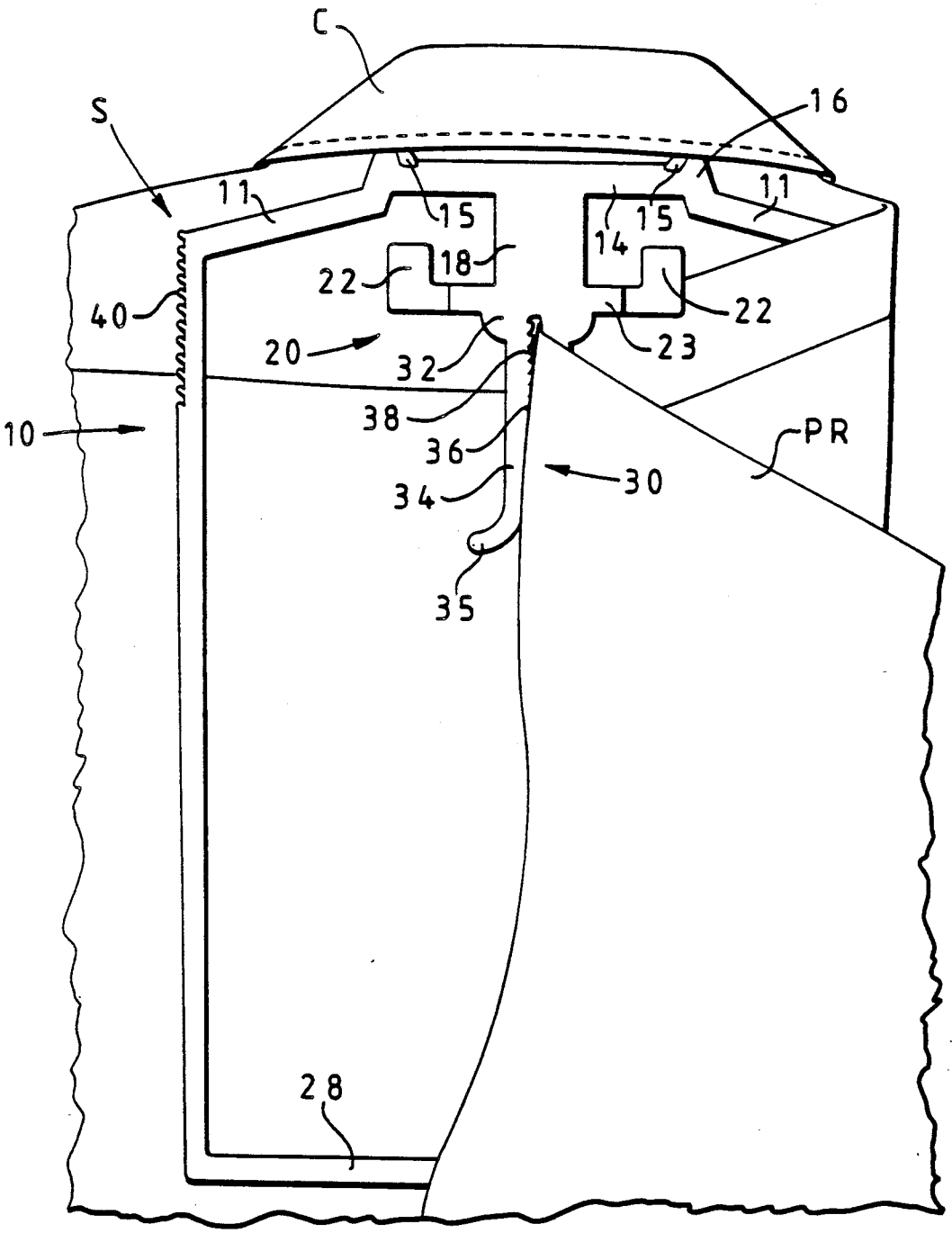
FIGS. 7 to 11 are rear elevational views each showing a step in the arranging or folding of a shirt on the former.
Figure 8:
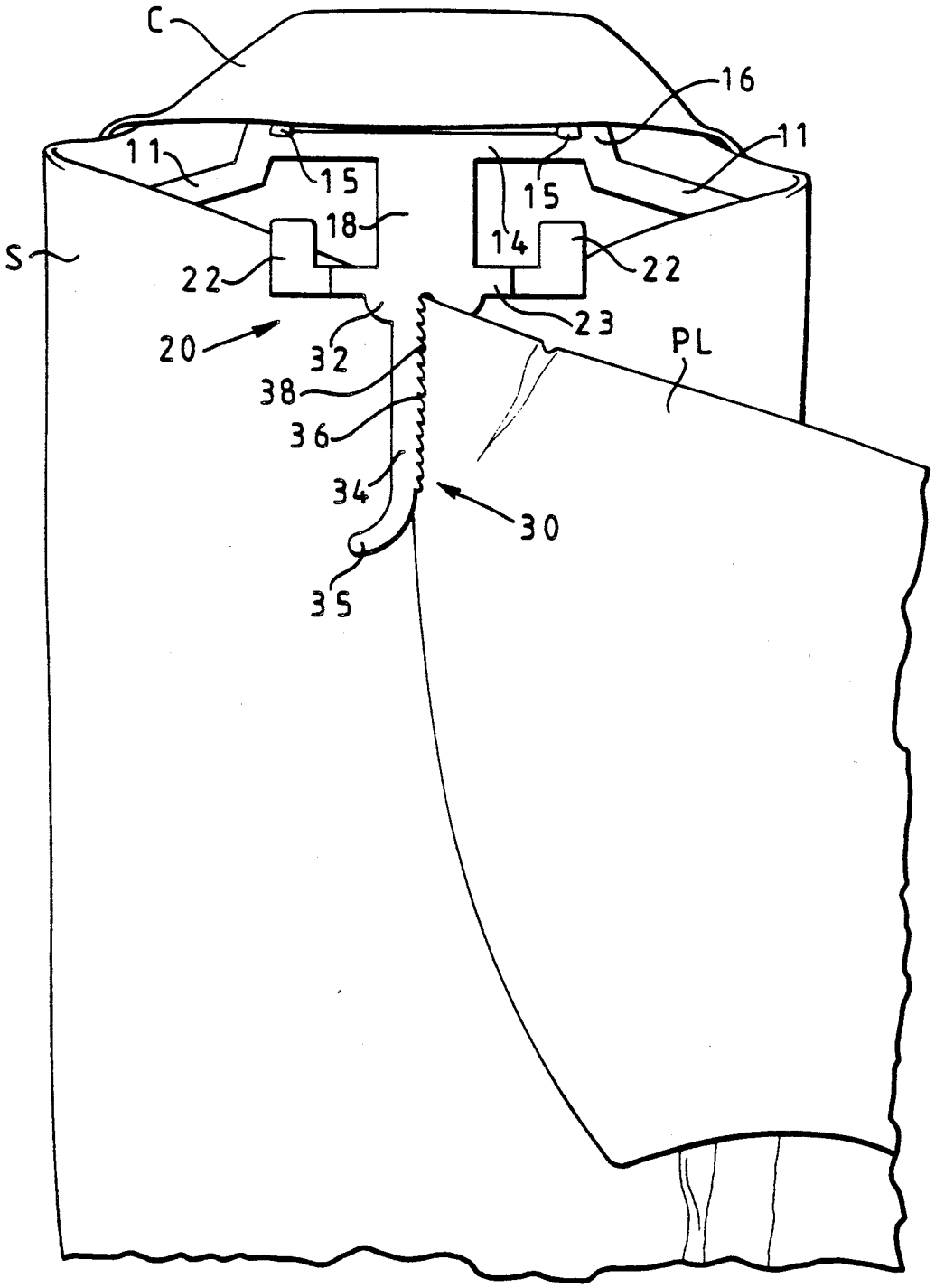

In displaying a shirt on the former 10 and referring to FIGS. 7 to 11 as before the back portion of the shirt collar C is engaged over the collar support 16 so that the former 10 lies behind the shirt. One outer side portion PR of the shirt, e.g. the right hand side portion in FIG. 7 is pulled inwardly behind the former 10 and the shoulder part of this shirt portion PR is inserted upwardly into the slot 36 between the depending limbs 34 which latter are outwardly curved at their lower ends 35 to facilitate such engagement. The lower cross piece 28 of the former frame 10 is notched at 29 to assist in centering the shirt S on the former. In a similar manner the other or left hand outer side portion PL of the shirt S (FIG. 8) is pulled inwardly behind the former 10 and its shoulder part inserted in the slot 36. On such engagement of the shirt portions PR, PL, with the slot 36 they are pulled taut to ensure gripping engagement with teeth 38 in the slot 36 and also similar wrap round engagement of upper portions of the shirt with the serrated outer edges 40 of the upper part of the former frame 10. This ensures a suitably taut display of the front of the shirt. Loose portions PR, PL of the shirt extending rearwardly out of the slot 36 together with sleeves are folded behind that part of the shirt wrapped about the former, i.e. in the manner shown in FIG. 9.

If desired more than one slot 36 such as a parallel pair thereof may be provided. Other suitable slotting may be employed.

Figure 9:
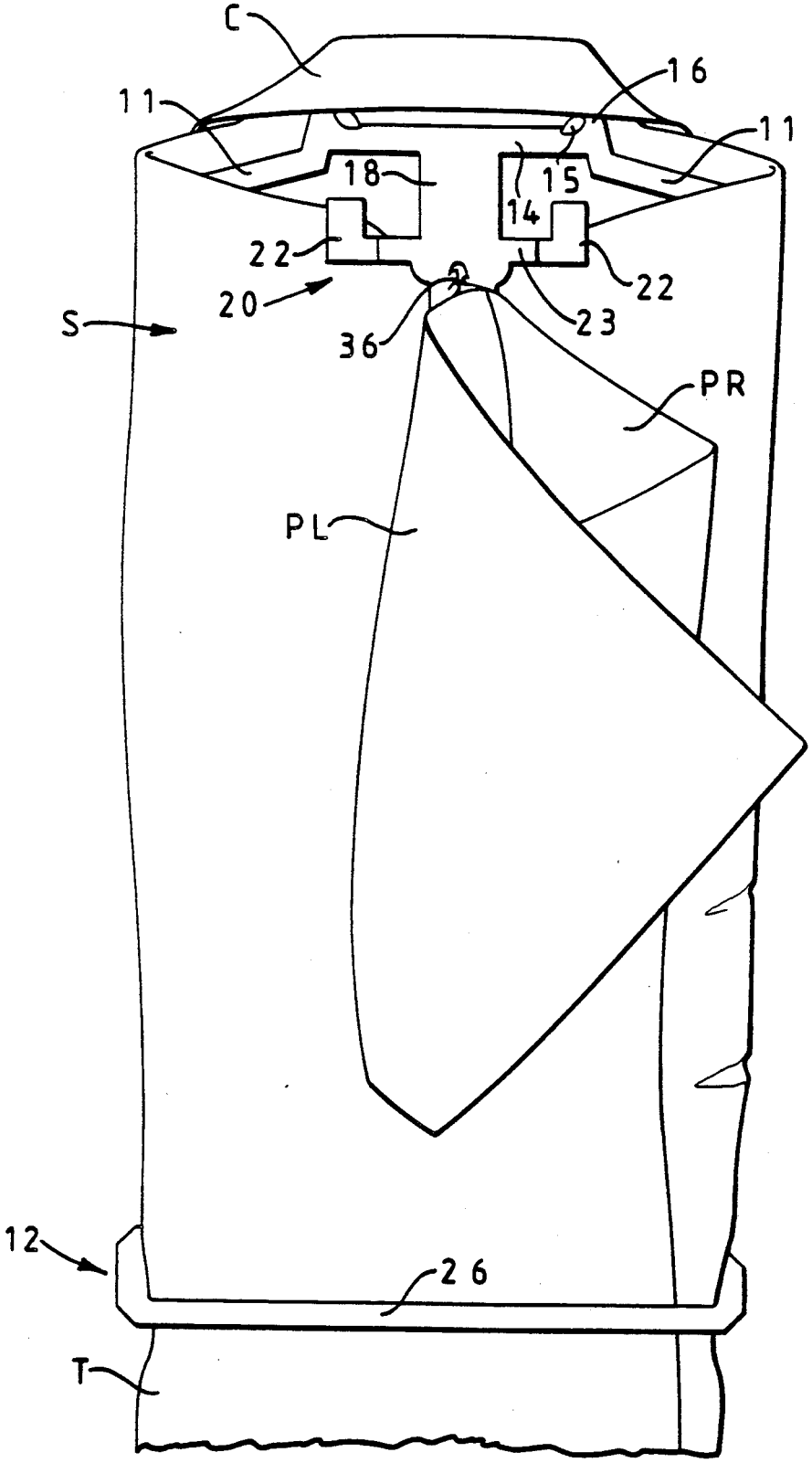
Figure 10:
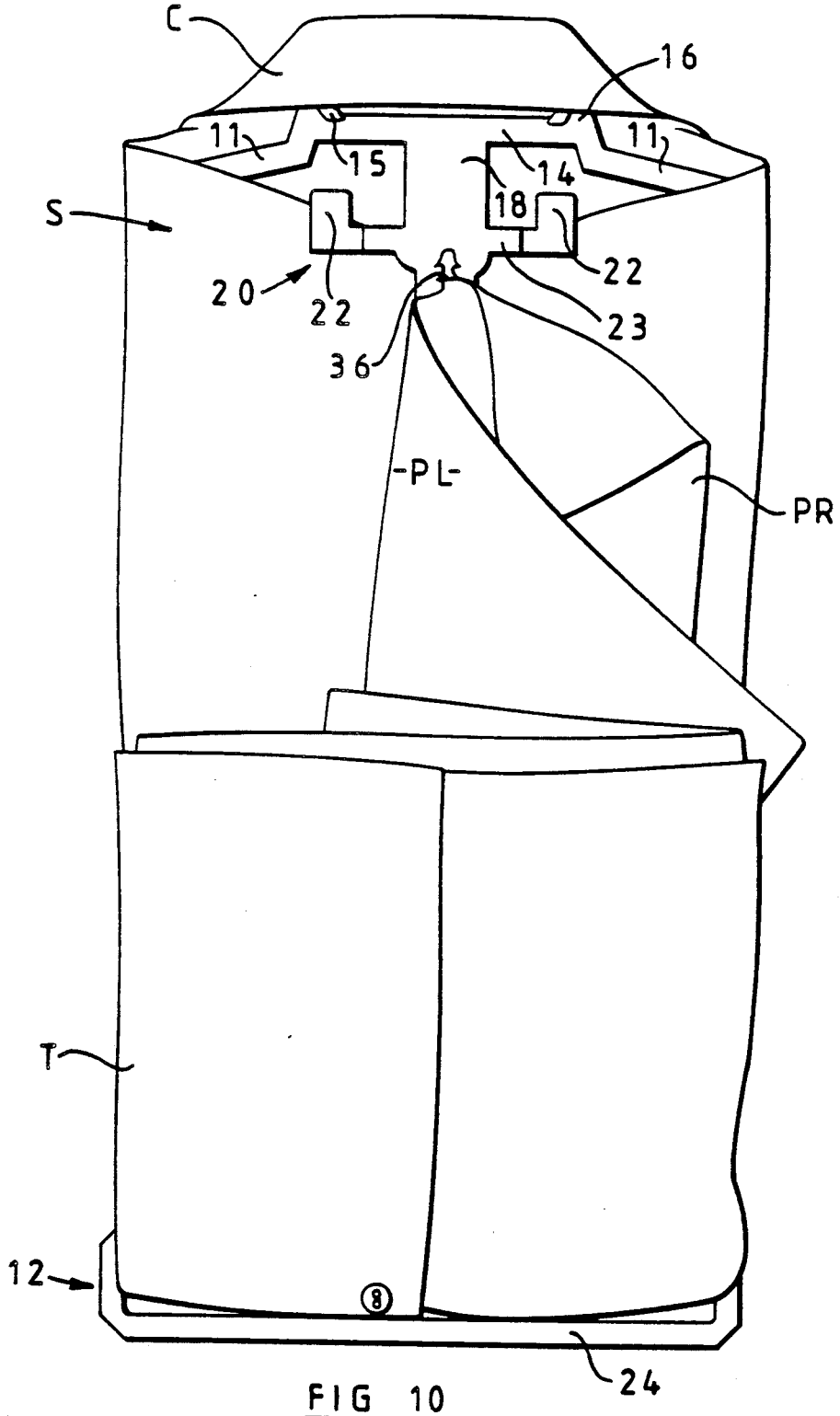
Figure 11:
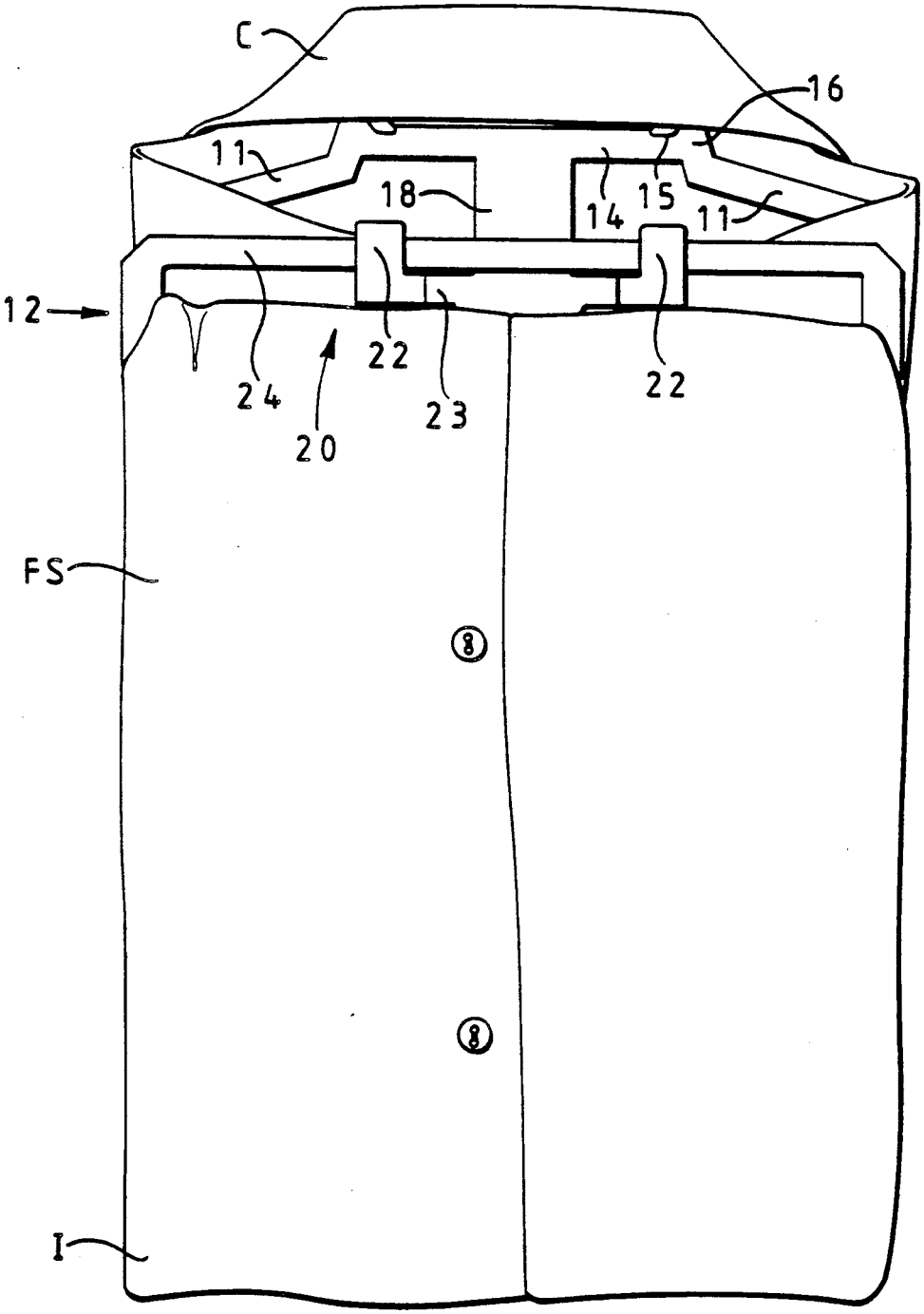
Figure 12:
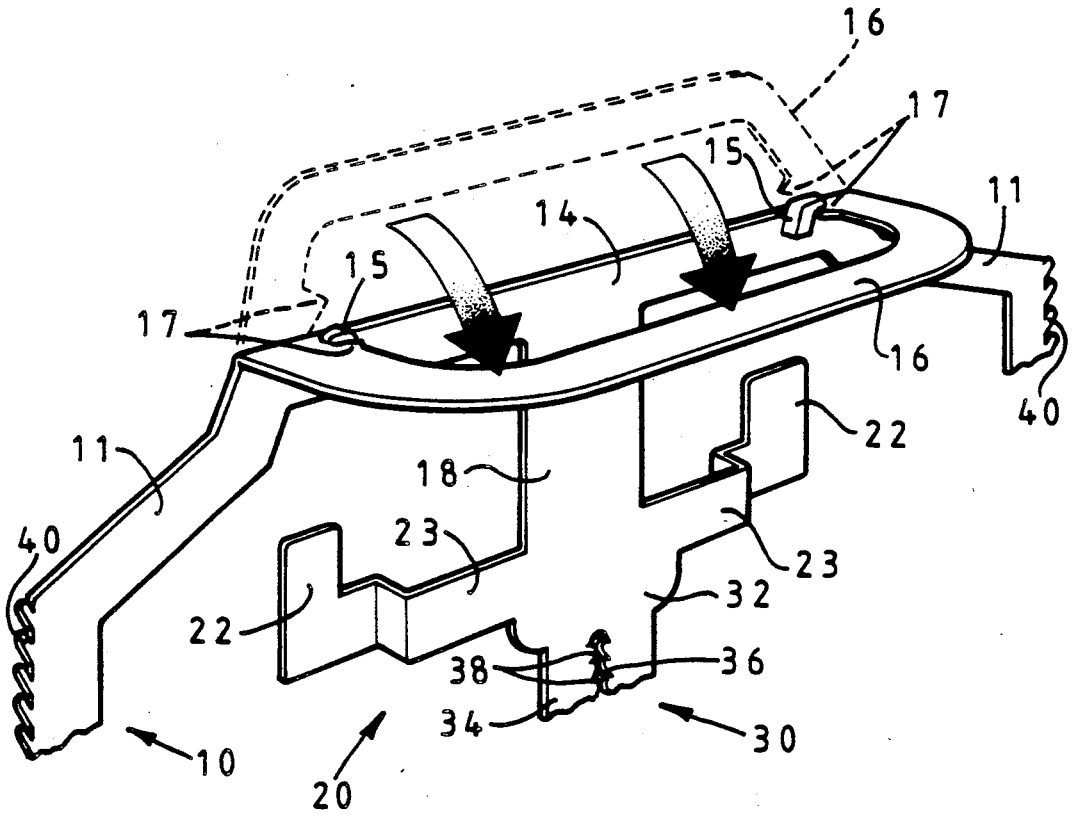
FIG. 12 is a detail front perspective view on an enlarged, scale of a further form of collar support.

Also as shown in FIG. 9 the lower or tail portion T of the folded shirt is inserted through the locking support frame 12 and folded forwardly over the bar 26 as shown in FIG. 10. Also in the manner already described the bar 24, now visible just below the lower most edge of the folded shirt S and with a further transverse folding of the latter is placed over the hooks 22 (FIG. 11) to secure and lock the shirt in the fully folded conditions FS on the former 10. In order to accommodate the folded thickness of the shirt the hooks 22 are shown cranked rearwardly from their arms 23 as will be seen in FIG. 12.

In order to raise the collar C forwardly of the front of the shirt, especially the rear part of the collar, the collar support 160 is arranged to be bent to a forward position upstanding from the former 10 and shirt front as shown in FIG. 7. The collar support 160 is retained in this position by snap action engagement of projections 17 of the support 160 engaging under hook shaped lugs 15 on the cross piece 14. When in the position shown in dotted lines the support 160 lies in the same plane as the former 10 for ease of packaging and shipping a quantity of formers along with flat locking supports 12.

As will be appreciated from the foregoing, the procedure of arranging and folding the shirt S on the former 10 can be carried out very quickly including the raised positioning of the collar C and that, in particular, there is no need to previously fold the shirt before fitting it on the former 10 nor is the use of pins or clips entailed. This results in considerably more efficient production of displayed shirts, the operating costs of which are further kept to a minimum by the extremely low cost nature of the former 10 and locking support frame 12.

Whereas an embodiment of the invention has been herein described as suitable for the display of shirts it is to be understood that, with such modification as may be necessary, it is also applicable to the display of other similar garments such as blouses, pyjamas, jackets, nightdresses and the like.

It is also to be understood that various modifications of the former and locking support frame may be made within the scope of the invention herein defined.

We claim:

1. A garment display former comprising:

a) a generally rectangular former frame for receiving the upper portion of a garment frontally on the front of the frame with outer side portions of the garment folded about the sides of the frame to the rear thereof and the lower portion of the garment folded under and behind the frame, and b) a separate locking support member having a transverse bar for receiving the lower portion of a said garment folded thereover said separate locking support member and supported thereby, said locking support member further having means for releasable retentive engagement with a rear upper part of the former frame wherein the folded lower portion of the garment is removably supported behind the frame and thus behind the upper portion of the garment on the front of the frame.

2. A garment display former according to claim 11 wherein the locking support member has a releasable retentive hook engagement with the rear upper part of the former frame.

3. A garment display former according to claim 11 wherein the locking support member has a further transverse bar spaced apart from and parallel with said transverse bar which supports the lower portion of said garment, said further bar having a releasable retentive engagement with hook means on the rear upper part of the former frame.

4. A garment display former according to claim 13 wherein the hook means has a resilient action for retaining said hook engagement yet enables its release to be obtained for removal of the locking support member from the rear upper part of the former frame.

5. A garment display former according to claim 11 wherein a rear upper part of the former frame is provided with gripping means depending therefrom, which gripping means is provided with longitudinal slotting open at its lower end for the insertion and retention of upper outer side portions of a garment therein behind the former frame.

6. A garment display former according to claim 15 wherein the edges of the slotting are serrated for gripping retentive engagement with said upper outer side portions of a garment inserted in the slotting.

7. A garment display former according to claim 15 wherein the depending gripping means is substantially centrally positioned in relation to the rear upper part of the former frame.

8. A garment display former according to claim 11 wherein the upper part of the former frame is provided with a support for a collar of a garment when displayed on the former frame, which collar support is bendable from the plane of the former frame to a raised position for suitable support of the collar, retaining means being provided for retaining the collar support in the raised position from the former frame.

9. A garment display former according to claim 18 wherein the retaining means provides a snap action engagement between the collar support and the former frame.

10. A garment display former comprising:

a) a generally rectangular former frame for receiving the upper portion of a garment frontally on the front of the frame with outer side portions of the garment folded about the sides of the frame to the rear thereof and the lower portion of the garment folded under and behind the frame;

b) hook means provided on a rear upper part of said former frame;

c) a separate locking support member having a transverse bar for receiving the lower portion of a said garment folded thereover said separate locking support member and supported thereby, said locking support member having a further transverse bar spaced apart from and parallel with the aforesaid supporting transverse bar, which further bar has a releasable retentive engagement with the hook means on the rear upper part of the former frame wherein the folded lower portion of the garment is removably supported behind the frame and thus behind the upper portion of the garment on the front of the frame;

d) gripping means depending substantially centrally from the rear upper part of the former frame and provided with longitudinal slotting having serrated edges and opened at its lower end for the insertion and retention of upper outer side portions of a garment therein behind the former frame;

e) a support for a collar of a garment when displayed on the former frame, which collar support is bendable from the plane of the former frame to a raised position for suitable support of the collar, and f) retaining means for retaining the collar support in the raised position from the former frame.

* * * * *